United States Patent [19]

Jabloner

[11] Patent Number: 4,678,823

[45] Date of Patent: Jul. 7, 1987

[54] ASPHALT COMPOSITIONS CONTAINING SPURTED POLYOLEFIN FIBERS WITH IMPROVED DISPERSIBILITY IN HYDROCARBONS

[75] Inventor: Harold Jabloner, Wilmington, Del.

[73] Assignee: Hercules Incorporated, Wilmington, Del.

[21] Appl. No.: 869,553

[22] Filed: Jun. 2, 1986

Related U.S. Application Data

[60] Division of Ser. No. 586,891, Mar. 12, 1984, which is a continuation of Ser. No. 365,719, Apr. 5, 1982, abandoned.

[51] Int. Cl.[4] ..... C08L 95/00

[52] U.S. Cl. ..... 524/62; 523/335; 428/394; 524/60

[58] Field of Search ..... 524/60, 62, 68, 70

[56] References Cited

U.S. PATENT DOCUMENTS

| | | | |
|---|---|---|---|
| 3,154,508 | 10/1964 | Clelland | 524/70 |
| 3,218,224 | 11/1965 | Osborn | 161/247 |
| 3,405,004 | 10/1968 | Hall et al. | 117/155 |
| 3,503,311 | 3/1970 | Gagle et al. | 94/18 |
| 3,505,260 | 4/1970 | Woodruff | 260/28.5 |
| 3,632,418 | 1/1972 | Draper | 117/138.8 |
| 3,728,211 | 4/1973 | Ball et al. | 161/170 |
| 3,856,732 | 12/1974 | Bresson et al. | 524/70 |
| 4,154,647 | 5/1979 | Rave | 162/157 |
| 4,422,878 | 12/1983 | Fry | 106/219 |
| 4,492,781 | 1/1985 | Duszak et al. | 524/59 |
| 4,502,814 | 3/1985 | Trimble | 404/107 |

FOREIGN PATENT DOCUMENTS 55-086822 7/1980 Japan .

*Primary Examiner*—Jacob Ziegler
*Attorney, Agent, or Firm*—Joanne W. Patterson

[57] ABSTRACT

To an aqueous dispersion of spurted polyolefin pulp is added from about 1% to about 20%, preferably from about 2% to about 12%, by solid weight based on the weight of spurted polyolefin pulp, of an anionic latex containing a natural rubber or synthetic which is swellable in hydrocarbons. The latex is then precipitated onto the spurted polyolefin pulp with a suitable agent, preferably water-soluble calcium, magnesium, barium or aluminum salts or calcium or barium hydroxides. When the product is recovered, the resulting natural rubber or synthetic treated spurted polyolefin pulp is readily dispersible in hydrocarbons. Because of this, the pulp can be added to cutback asphalt to form viscous compositions which can be readily sprayed, brushed and troweled with minimal pulp separation problems.

11 Claims, No Drawings

ASPHALT COMPOSITIONS CONTAINING SPURTED POLYOLEFIN FIBERS WITH IMPROVED DISPERSIBILITY IN HYDROCARBONS

This application is a division of application Ser. No. 586,891 filed Mar. 12, 1984, which is a continuation of application Ser. No. 365,719 filed Apr. 5, 1982, now abandoned.

BACKGROUND OF THE INVENTION

This invention relates to spurted polyolefin pulp. More particularly, the invention relates to spurted polyolefin pulp having precipitated thereon a natural rubber or a synthetic elastomer. The pulp is readily dispersible in organic media and is particularly useful as an additive to cutback asphalt compositions.

As is well known, cutback asphalt compositions have long been used, primarily in the construction industry, as coatings and cements. Typically, cutback asphalt compositions have a viscosity less than about 2,000 cps. In many instances, it has been desirable to include fibers in the compositions to thicken them while at the same time improving their rheology so as to permit ready spraying, brushing and trowelling. Asbestos has been particularly suitable as the fiber component of such asphalt compositions.

However, due to the health hazards associated with the use of asbestos, considerable effort has recently been directed in the art to the development of asbestos-free formulations having the desirable properties of the asbestos-based compositions. Considerable work has been done, for example, with synthetic fibers, including polyolefin fibers. Polyolefin fibers were found to be effective from the standpoint of thickening the cutback asphalt compositions, but the fibers exhibited a tendency to clump together and float on the surface of the compositions. Obviously, the polyolefin fibers did not remain well dispersed in the organic medium presented by the cutback asphalt compositions and as a consequence, the rheological properties of the compositions were very poor.

Now, in accordance with this invention, a cutback asphalt composition containing well dispersed polyolefin pulp has been found, said composition comprising asphalt, a hydrocarbon solvent and spurted polyolefin pulp having precipitated thereon a natural rubber or a synthetic elastomer. The pulp is readily dispersible in the cutback asphalt, remains well dispersed therein for several days and is easily redispersed using mild stirring if separation occurs after prolonged storage. Furthermore, the composition has the desired rheological properties and, upon application, is resistant to cracking and to slumping.

The indicated pulp is prepared by adding water dispersible spurted polyolefin pulp in low concentration to water; agitating the resulting mixture to form an aqueous dispersion of the pulp; adding to the dispersion, with continued agitation, an anionic latex of a natural rubber or a synthetic elastomer; precipitating said natural rubber or synthetic elastomer onto the polyolefin pulp by adding to the agitated aqueous dispersion containing said pulp and said anionic latex an agent capable of precipitating an anionic latex, preferably a water-soluble calcium, barium, magnesium or aluminum salt or calcium or barium hydroxide and then isolating the treated pulp so formed from the aqueous dispersion.

Having generally outlined the embodiments of this invention, the following examples provide more specific details pertaining to the invention. All amounts are based on parts by weight unless otherwise indicated.

EXAMPLE 1

Ethanol refined spurted polypropylene pulp was made by placing into a Waring Blender, 2 liters of ethyl alcohol and 113.5 g of spurted polypropylene pulp. The pulp was refined for two minutes in the blender, filtered and allowed to dry at room temperature.

Water dispersible treated spurted polypropylene pulp was made by mixing 3.5 liters water and 56.75 g of a 1% aqueous solution of a cationic copolymer which was 66% by weight acrylamide and 34% by weight methacryloyloxyethyltrimethylammonium methyl sulfate. The pH of the solution was adjusted to 10 with aqueous sodium hydroxide. Then 113.5 g of spurted polypropylene pulp was added and refined in a Waring Blender for one minute.

The water dispersible polypropylene pulp was latex treated by adding 10.99 g of a 51.6% emulsion of a carboxylated styrene-butadiene latex commercially available as Polysar XD 958, from Polysar Ltd. of Sarnia, Ontario, to the water dispersion. The mixture was beaten for 20 seconds.

A sufficient amount of an aqueous 10% barium chloride solution was added to precipitate the latex onto the pulp. The treated pulp was filtered and dried at room temperature.

Two asphalt cutback compositions were made. The first contained five grams of ethanol refined pulp in 400 g cutback asphalt. The second contained five grams latex treated pulp in 400 g of asphalt. For each composition the pulp was dispersed using a Hobart Planetary Mixer for 30 minutes. After dispersion the viscosity of each asphalt composition was measured using a Brookfield RVT model viscometer and a #6 spindle at 1 rpm. The composition containing the ethanol refined pulp had a viscosity of 28,000 cps while the latex-treated pulp containing composition had a viscosity of 14,200 cps. Each composition was then placed in a metal can and aged at 66° C. for three days. Examination after that time showed the latex treated pulp had only slightly separated from the cutback and was easily redispersed. The ethanol refined pulp was greatly separated and did not redisperse easily.

EXAMPLE 2

A solution was prepared containing 1.14 g of the cationic copolymer described in Example 1 dissolved in 20 liters of water at a pH of 10. The solution was circulated in a Sprout-Waldren single disc, 12 inch refiner equipped with D2A502 blades. Then 227 grams spurted polypropylene pulp was added and refined for 5 minutes at one mil blade clearance. This procedure was duplicated and the materials were combined. Pulp length was measured by Bauer McNett procedure essentially as described in TAPPI standard T233. The only change was a reduction in weight of pulp charged to 2 grams, which was necessitated by the lower density of the synthetic pulp. The measurement established that 2.1% of the pulp was retained on a 24 mesh screen while 28.2% of the pulp was retained on a 48 mesh screen. The refined water dispersible pulp slurry was divided into eight 50 g. portions. To each portion was added a diferent latex as outlined in Table 1. The amount of latex added to each portion was chosen to give 10% by weight of latex solids based on the weight of the spurted polypropylene pulp. Each latex was the precipitated onto the pulp by slowly adding a 10% aqueous calcium hydroxide slurry. The amount of calcium hydoxide needed to precipitate the latex was predetermined in the following manner: Each latex was added to sufficient water to make a 0.15% solids dispersion. 14 ml of each dispersion was then placed in three bottles. To each of the three bottles was added 0.1, 0.5, or 1.0 ml respectively of a calcium hydroxide slurry prepared by adding 10 grams of calcium oxide to 90 ml of water. The diluted latex samples plus calcium hydroxide were allowed to stand overnight and the minimum amount of calcium hydroxide required to clear the dilute latex was visually determined. This amount was then used to calculate the volume needed to precititate the latex in the presence of the spurted polypropylene pulp.

The eight samples were dried at ambient conditions and each dispersed in an asphalt cutback at 1.25% pulp concentration. The pulps were dispersed by mixing in a Hobart Planetary Mixer for 30 minutes. The viscosities of the various samples are reported in Table 1.

For each asphalt cutback composition 500 grams were placed in a metal container and allowed to age for eight days. Then the dispersions were poured onto an eight inch diameter standard sieve with one-quarter inch openings. The amount of each composition that was retained on the sieve when the sieve was blinded and would no longer allow the latex treated pulp to pass through is recorded in Table 1.

TABLE 1

| Sample Number | Latex Used | Trade Name | Brookfield Viscosity 1 rpm, cps | Amount Retained on Screen (g/500 g initially charged) |
|---|---|---|---|---|
| 1 | None | — | 100,000 | 289 |
| 2 | Natural Rubber | Firestone Hartex 103 | 48,000 | 206 |
| 3 | Butadiene | Goodyear Pliolite LPM6433 | 72,000 | 240 |
| 4 | Neoprene | duPont Neoprene Latex-type 115 | 30,000 | 81 |
| 5 | Acrylic | Rohm & Haas Rhoplex N-580 | 24,000 | 82 |
| 6 | Acrylic | Union Carbide UCAR175 | 66,000 | 207 |
| 7 | Acrylic | Union Carbide UCAR173 | 87,000 | 218 |
| 8 | Styrene-butadiene | Firestone FRS2002 | 51,000 | 205 |

EXAMPLE 3

Five samples were made in the manner outlined in Example 2, except that the spurted polypropylene pulp was refined for 9 minutes at a 3 mil clearance. Each sample was prepared with 10% by weight of a different carboxylated styrene-butadiene latex. The particular latex used is shown in Table 2.

Each sample was used to make a different asphalt composition Each composition consisted of 1.5% by weight treated pulp and 98.5% asphalt cutback. Slump resistance of these formulations in asphalt cutback was determined by applying a 150 mil coat of the composition to a 15.pound roofing felt. The coating was allowed to dry for two days at room temperature and 8 hours at 150° F. The samples were rated as failing if any amount of asphalt dripped off.

TABLE 2

| Sample | Latex Used | Brookfield Viscosity at 1.25% 1 rpm | 10 rpm | Dry Slump |
|---|---|---|---|---|
| 1 | Dow #241 | 100,000 | 25,500 | All samples passed at 96 hours |
| 2 | Dow #293 | 85,600 | 24,200 | |
| 3 | Dow #XD30406.00 | 94,000 | 23,400 | |
| 4 | Polysar XD958 | 87,600 | 23,800 | |
| 5 | Grace Darex 526L | 90,000 | 22,800 | |

EXAMPLE 4

Water dispersible spurted polypropylene pulp was prepared as outlined in Example 2. To three 227 g. portions of the pulp sufficient carboxylated styrene-butadiene latex, commercially available as Polysar XD-958, sold by Polysar Ltd., Sarnia, Ontario, was added so that there was 5% latex solids based on the weight of the pulps. The latex was then precipitated onto the pulp of each portion by use of a different precipitation agent. The precipitation agent used is outlined in Table 3. Finally, the pulp was filtered and dried.

Each latex treated pulp was then added at 1.25% by weight to a cutback asphalt to form three different samples. And each of the cutback asphalt samples was placed in metal cans and after the first day, aged at 66° C. The amount of pulp separation for the three cutback asphalt samples was determined after 1, 2, and 6 days. The results are shown in Table 3. The ratings are relative to one another; a rating of one indicated the best sample.

TABLE 3

| Sample Number | Precipitation Agent | Brookfield Viscosity, 10 rpm | Separation 1 Day 25° C. | Separation 3 Days 66° C. | Separation 6 Days 66° C. |
|---|---|---|---|---|---|
| 1 | Dilute Alum to pH 4.5 | 30,000 | none | 2 | 2 |
| 2 | Ca.14 g $BaCl_2$ | 32,000 | none | 1 | 1 |
| 3 | Dilute $H_2SO_4$ to pH 2.63 | 30,500 | partial | 3 | 3 |

EXAMPLE 5

Four samples containing latex treated spurted polypropylene pulp were made as outlined in Example 2 except for the refining. As shown in Table 4, the first sample was refined for 5 minutes at a 10 mil clearance after latex precipitation. The other three samples were refined for 5 minutes with a 10 mil clearance before the latex was added.

To the water dispersible spurted polypropylene pulp was added sufficient carboxylated styrene butadiene latex, commercially available as Polysar XD-958, sold by Polysar Ltd., Sarnia, Ontario, to produce the percent of latex solids based on the weight of the pulps indicated in Table 4. Sufficient precipitating agent either aqueous 10% barium chloride solution or aqueous 10% calcium hydroxide slurry was used to precipitate the latex onto the pulp. The latex treated pulp was filtered and dried. The four samples were used to make four different cutback asphalt compositions in the manner outlined in Example 1. The compositions were visually inspected after three days and the results were recorded in Table 4. The ratings are relative to each other, a rating of one indicates the best sample.

TABLE 4

| Sample | Refining | Treatment | Viscosity | Separation 3 days 66° C. |
|---|---|---|---|---|
| 1 | 5 min, 10 mil, after pp'n of latex | 10% Latex, solid $Ba^{2+}$ | 21,000 | 2 |
| 2 | 5 min, 10 mil | 10% Latex, $Ca^{2+}$ | 20,000 | 1 |
| 3 | 5 min, 10 mil | 20% Latex, $Ba^{2+}$ | 23,000 | 4 |
| 4 | 5 min, 10 mil | 20% Latex, $Ca^{2+}$ | 18,000 | 2 |

EXAMPLE 6

100 lbs. of spurted polypropylene pulp, which had been treated with the cationic polymer described in Example 1 to make it water dispersible, was dispersed in 5000 lbs. of water in a Black Clawson hydrapulper with the pH adjusted to 9–10. The slurry was pumped to a refiner chest where it was constantly stirred. For refining, the slurry was pumped from the bottom of the refiner chest through a Sprout Waldron double disk refiner and into the top of the same refiner chest. The pump rate was 140 gallons per minute. At the end of the third pass the pulp length distribution was such that 0.1% was retained on a 24 mesh screen while 11.7% was retained on a 48 mesh screen.

To the refined spurted polypropylene pulp was added 0.3 lbs. by dry weight of a commercially available cationic polyamide flocculent in order subsequently to improve the clarity of the white water. The mixture was stirred for 10 minutes and then 6 lbs. by dry weight of a carboxylated styrene-butadiene latex, commercially available as Dow latex 241, was added over a 10 minute period while stirring. 1.38 lbs., by dry weight, of calcium oxide was mixed with 12.4 lbs. of water. The resulting calcium hydroxide slurry was added in four portions with about 4 to 5 minutes allowed between each addition.

The pulps were wet lapped on the wet end of a Fourdrinier and dried.

A standard roof coating mix was made with 1.5% of the treated pulp and 98.5% dead level asphalt cutback by weight. The cutback was 65% dead level asphalt and 35% mineral spirits. The asphalt cutback had a Brookfield Viscosity of 1300 cps at 25° C. (25 rpm, #3 spindle). Using a Hobart Planetary Mixer the treated pulp was blended into the asphalt cutback in about ½ minute. The mix was stirred for 10 minutes at which time it had a smooth creamy, buttery consistency. Examination of a smear under a microscope slide showed a fine dispersion and only a hint of pulp grouping. The mix troweled smoothly without lumps. The mixture poured smoothly and only showed slight floccing. The Brookfield viscosities at 25° C. (#6 spindle) after standing overnight were:

| 1 RPM | 10 RPM | 20 RPM | 50 RPM |
|---|---|---|---|
| 65,000 cps | 21,000 cps | 15,500 cps | 11,100 cps |

After seven days at 150° F., the pulps floated to the top. The pulps were easily redispersed with gentle stirring. There was only light floccing. In a wet slump test (40 mils thick), the cutback ran off at 100° F. in 5 hours. In the dry slump test (150 mils air dried 150° F.), about 10% of the coating ran off.

An aluminum roof coating was made by combining 520 grams, asphalt dead level cutback which had a viscosity of 1300 cps.; 40 grams, talc (5 micron size); 46 grams, talc (16 micron size); 10 grams of the treated pulp and 184 grams, Alcoa Aluminum Paste #6233, an aluminum flake pigment homogeneously incorporated in a solvent such as mineral spirits. The spurted polyolefin pulp immediately mixed into the cutback to give a smooth creamy mix. The total mix time was eleven minutes. The pulp was well dispersed. The mixture poured smoothly with only slight floccing.

The Brookfield viscosities with a #6 spindle at 25 were:

| 1 RPM | 10 RPM | 20 RPM | 50 RPM |
|---|---|---|---|
| 150,000 cps. | 41,000 cps. | 32,000 cps | off scale |

After 7 days at 150° F., there was about ½" cutback on top. With gentle stirring the pulp and pigment redispersed.

EXAMPLE 7

100 lbs., by dry weight, spurted polypropylene pulp which had been treated with poly(vinyl alcohol) to make it water dispersible and 5,000 lbs. water was charged to a hydrapulper and dispersed. The pulp length distribution was such that about 1% was retained on a 24 mesh screen, while about 21% was retained on a 48 mesh screen.

To the refined spurted polypropylene was added 0.3 lbs. by dry weight of a commercially available cationic polyamide flocculent in order subsequently to improve the clarity of the white water. The mixture was stirred and then was added 6 lbs., dry weight, of a carboxylated styrene butadiene latex, commercially available as Dow Latex 241. The mixture was stirred for 10 minutes. Then 1.38 lbs., dry weight, of CaO which was slaked in 5.5 lbs. water was poured into the hydrapulper over a period of 1 to 2 minutes. Mixing was continued for an additional 10 minutes. This slurry was then pumped to a stock chest for 20 minutes.

The pulp was isolated and then dewatered to form wet lap. The solids content of the wet lap was about 50 to 52% by weight and it was 10 to 12 mils thick.

The procedure was repeated except that only 3 lbs. of latex was added.

Two cutback asphalt compositions were made by adding to 98.5% by weight asphalt cutback 1.5% by weight of the two samples respectively. The Brookfield viscosities of the samples at 25° C. (#6 spindle) were determined and are shown in Table 5.

After setting for 24 hours at 150° F., the pulp floated to the top of both samples. In each case, the pulp was readily redispersed.

Both samples passed the dry slump test as outlined in Example 3.

TABLE 5

| | Brookfield Viscosity (CPS) #6 Spindle | | | | |
|---|---|---|---|---|---|
| Sample | 1 RPM | 10 RPM | 20 RPM | 50 RPM | Dry Slump |
| 1 | 130,000 | 28,000 | 20,000 | 13,500 | No movement passed |
| 2 | 140,000 | 27,000 | 24,000 | 13,000 | No movement passed |

The cutback asphalts used in accordance with this invention are well known in the art. They are formed by diluting asphalt to a liquid or semi-solid state using a petroleum thinner mainly composed of aliphatic hydrocarbons, such as mineral spirits, either alone or in conjunction with a small amount of aromatic hydrocarbons, such as benzene, toluene or xylene, to assist in solubilizing the asphalt. The asphalt component itself is a solid or semi-solid bitumen which can occur either naturally or can be obtained as a residue in the refining of petroleum. The solids content of the cutback asphalts will ordinarily range from about 20 to about 70% by weight based on the total weight of the cutback composition.

Among the spurted polyolefin pulps which can be used in accordance with this invention are polypropylene and polyethylene which are both commercially available. These pulps are generally treated so as to make them water dispersible before they are sold.

Alternatively, the spurted polyolefin pulps may be prepared by a process wherein the polyolefin is dispersed in a liquid which is not a solvent for the polyolefin at its normal boiling point, heating the resulting dispersion at superatmospheric pressure to dissolve the polymer and then discharging the resulting solution into a zone of reduced temperature and pressure to form the fibrous product. The liquid in which the polyolefin is dispersed may be a halogenated hydrocarbon such as methylene chloride, chloroform or carbon tetrachloride; an aromatic hydrocarbon such as benzene, toluene or xylene; an aliphatic hydrocarbon such as pentane or hexane; or an alicyclic hydrocarbon such as cyclohexane. Mixtures of these solvents may be used, and water may be present when it is desired to form an emulsion of the polyolefin. Moreover, the pressure generated by the solvent vapors may be augmented by a pressurized inert gas such as nitrogen or carbon dioxide.

The temperature to which the dispersion of the polyolefin in the solvent is heated to form a solution of the polyolefin will depend upon the particular solvent used but should be sufficiently high to effect dissolution of the polyolefin. Temperatures in the range of about 100° to about 225° C. ordinarily will be used, and the concentration of the polyolefin in the resulting solution normally will be from about 5 to about 40% by weight. The pressure on the polyolefin solution may be from about 600 to about 1500 p.s.i., preferably from about 900 to about 1200 p.s.i. The orifice through which the solution is discharged will have a diameter of from about ½ to about 15 mm and a length to diameter ratio of from about 1/5 to about 10 mm.

The polyolefin pulp shown in the examples are spurted polypropylene pulp. However, there may also be used spurted polyethylene pulp and spurted pulps prepared from copolymers of ethylene and propylene, copolymers of propylene and other 1-olefins such as 1-butene, 4-methyl-pentene-1 and 1-hexene, and mixtures of any of the aforementioned polymers.

The pulp length distribution of the spurted polyolefin pulp plays an integral part in determining the viscosity of the cutback asphalt composition. Fiber lengths are commonly reported in terms of their Bauer-McNett classification. Using this classification it is desirable that the pulp length distribution contain less than 2.5% pulps retained on a 24 mesh screen and from about 10% to about 30% pulps retained on a 48 mesh screen. If the pulp is too short the viscosity of the asphalt composition is unacceptably low. If the pulp is too long the asphalt composition becomes lumpy and the pulp is hard to redisperse once it has separated from the cutback asphalt. It can be refined to the desired length by any of the methods known in the art. Typical of such refining methods is the use of a disc refiner.

Thus prepared, the spurted polyolefin pulp can be made water dispersible by dispersing it in an aqueous solution containing a dispersing agent. The dispersing agent may be cationic, anionic or nonionic.

Typical of applicable cationic dispersing agents are those formed by the copolymerization of from about 60 to about 85% by weight of an acrylamide having the formula:

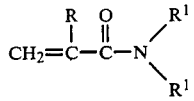

with from about 15 to about 40% by weight of an acrylate or methacrylate ester having the formula:

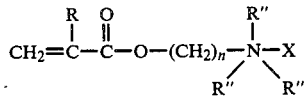

The amount of each monomer is based on the total monomers charged. R is hydrogen or methyl. R′ is hydrogen, methyl or ethyl. R″ is methyl or ethyl, at least one R″ being methyl when X is the methyl sulfate anion. Alternatively, X can be the chloride anion. And n is 1 to 4. When using these copolymers as dispersing agents, the pH of the aqueous solution containing them dissolved therein is adjusted to be in the range of from about 9.5 to about 12 either prior to, during or after contact of the polyolefin pulps with said solution.

A preferred dispersing agent is a cationic copolymer of acrylamide and methacrylate ester; more specifically, it is a copolymer of acrylamide and methacryloyloxyethyltrimethylammonium methyl sulfate (MTMMS). The amount of acrylamide in this particular copolymer is 66% by weight, and the amount of MTMMS is 34% by weight.

Other operable cationic dispersing agents include the tetraalkylammonium halides such as dodecyltrimethylammonium chloride or bromide, tetradecyltrimethylammonium chloride, hexadecyltriethylammonium iodide and octadecyltri-n-butylammonium chloride.

Representative anionic dispersing agents are the alkyl aryl sulfonates, such as sodium p-dodecylbenzene sulfonate, sodium isopropylnaphthalene sulfonate, sodium tetrahydronaphthalene sulfonate, sodium methylnaphthalene sulfonate, and the alkyl sulfates, such as sodium cetyl sulfate, ammonium lauryl sulfate and sodium tridecyl sulfate.

Exemplary nonionic dispersing agents are the polyvinyl alcohols as well as the aryloxypoly(ethyleneoxy) alkanols, such as phenoxypenta(ethyleneoxy)ethanol, phenoxyocta(ethyleneoxy)ethanol, phenoxydeca(ethyleneoxy)ethanol, 4-methylphenoxypenta(ethyleneoxy)ethanol and 2,3,6-triethylphenoxyhepta(ethyleneoxy)ethanol. Related compounds containing both ethyleneoxy and propyleneoxy groups are also useful nonionic dispersing agents. All of the aforementioned dispersing agents are used in the amounts ordinarily required to provide an effective dispersion of pulps in an aqueous medium. Other methods of dispersion such as oxidation or ozonolysis of the spurted polyolefin pulp or addition of alkali treated water-soluble polymers containing quaternary ammonium groups will be known to those skilled in the art.

Once water dispersible spurted polyolefin pulp is obtained it is added to water and agitated to form an aqueous dispersion. Only a small amount, preferably up to about 3% pulp by weight, is added to the water. If too much pulp is added the dispersion becomes impossible to pump or stir.

The natural rubber or synthetic elastomers which are to be precipitated onto the spurted polyolefin pulp are added to the agitated dispersion as anionic latices. It is the swelling of the precipitated natural rubber or synthetic elastomer when exposed to the solvent use in a cut back asphalt which gives rise to the dispersibility of the spurted polyolefin pulp in the cutback asphalt. Consequently, it is important that the natural rubber or synthetic elastomer be one that swells, but is not dissolved, in the solvent used to form the cutback asphalt. Suitable latices include those formed from natural rubber; butadiene-styrene rubber; neoprene; a carboxylated butadiene-styrene rubber such as a terpolymer containing butadiene, styrene and an anionic monomer such as acrylic or methacrylic acid; a butadiene-acrylonitrile rubber; polybutadiene rubber or polyisobutylene rubber. The latex may also be formed from a polyacrylic or polymethacrylic acid ester.

The latices containing the elastomers are anionic. This can be achieved via the anionic nature of the elastomer itself, i.e. an elastomer containing carboxyl functionality such as a carboxylated butadiene-styrene rubber, or through the use of an anionic emulsifier. Being in such form, the elastomers readily precipitate onto the surface of the spurted polyolefin pulp when from about 1% to about 20%, preferably from about 2% to about 12%, by weight of a solid precipitating agent based on the weight of spurted polyolefin pulp is added to the dispersion. Methods of precipitating anionic latices are known to those skilled in the art. Useful precipitating agents include water-soluble multivalent salts such as those of calcium, barium, magnesium, or aluminum or calcium or barium hydroxides. Other exemplary precipitants include aluminum sulfate, alum (hydrated sodium aluminum sulfate), calcium nitrate and calcium bromide.

Once the natural rubber or synthetic elastomer has been precipitated onto the spurted polyolefin pulp, the pulp may be isolated from the dispersion by conventional means.

What I claim and desire to protect by Letters Patent is:

1. In a cutback asphalt composition comprising asphalt and a hydrocarbon solvent, the improvement wherein the composition also comprises a water-dispersible spurted polyolefin pulp having precipitated thereon a natural rubber or synthetic elastomer that is swellable in hydrocarbon solvents.

2. The composition of claim 1, wherein the spurted polyolefin pulp is spurted polypropylene pulp.

3. The composition of claim 2 wherein the synthetic elastomer is a carboxylated butadiene-styrene rubber.

4. The composition of claim 3 wherein the carboxylated butadiene-styrene rubber is a styrene-butadiene-acrylic acid terpolymer.

5. In a cutback asphalt composition comprising asphalt and a hydrocarbon solvent, the improvement wherein the composition also comprises from about 0.5% to about 3% by weight of a water-dispersible spurted polyolefin pulp having precipitated thereon a natural rubber or a synthetic elastomer selected from the group consisting of butadiene-styrene rubber, neoprene, a carboxylated butadiene-styrene rubber, a butadiene-acrylonitrile rubber, polybutadiene rubber, polyisobutylene rubber or a polyacrylic or polymethacrylic acid ester.

6. The composition of claim 5, wherein the spurted polyolefin pulp is spurted polypropylene pulp.

7. The composition of claim 5, wherein the synthetic elastomer is a carboxylated butadiene-styrene rubber.

8. The composition of claim 7, wherein the carboxylated butadiene-styrene rubber is a styrene-butadiene-acrylic acid terpolymer.

9. The composition of claim 6 wherein the synthetic elastomer is a carboxylated butadiene-styrene rubber.

10. The composition of claim 9 wherein the carboxylated butadiene-styrene rubber is a styrene-butadiene-acrylic acid terpolymer.

11. The composition of claim 5 wherein the synthetic elastomer is neoprene.

* * * * *

UNITED STATES PATENT AND TRADEMARK OFFICE

CERTIFICATE OF CORRECTION

PATENT NO. : 4,678,823

DATED : July 7, 1987

INVENTOR(S) : Harold Jabloner

It is certified that error appears in the above-identified patent and that said Letters Patent is hereby corrected as shown below:

Column 8, second formula:

should read:

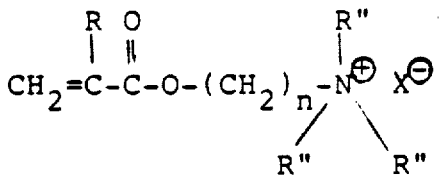

instead of

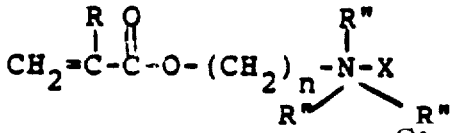

Signed and Sealed this

Seventh Day of June, 1988

*Attest:*

DONALD J. QUIGG

*Attesting Officer*

*Commissioner of Patents and Trademarks*